United States Patent [19]

Müller-Kühn et al.

[11] 4,356,929

[45] Nov. 2, 1982

[54] POP-TOP LID

[75] Inventors: Helmut Müller-Kühn; Günter Scharren, both of Mülheim-Ruhr; Wilfried Kohlmeier, Bottrop; Michael Grillo; Jürgen Rost, both of Essen, all of Fed. Rep. of Germany

[73] Assignee: Fried. Krupp Gesellschaft mit beschränkter Haftung, Essen, Fed. Rep. of Germany

[21] Appl. No.: 226,789

[22] Filed: Jan. 21, 1981

[30] Foreign Application Priority Data

Feb. 2, 1980 [DE] Fed. Rep. of Germany ..... 3003804

[51] Int. Cl.[3] ..... B65D 17/34; B65D 43/20

[52] U.S. Cl. ..... 220/270; 220/269; 220/345; 222/80; 222/541

[58] Field of Search ..... 220/268–270, 220/345, 346; 222/80, 541

[56] References Cited

U.S. PATENT DOCUMENTS

| | | | |
|---|---|---|---|
| 3,200,986 | 8/1965 | La Grutta | 220/307 |
| 3,856,184 | 12/1974 | Luviano | 222/80 |
| 4,106,662 | 8/1978 | Strobe et al. | 220/345 X |
| 4,162,742 | 7/1979 | Vogt | 220/269 |
| 4,170,724 | 10/1979 | Waterbury | 220/345 |

*Primary Examiner*—George T. Hall

*Attorney, Agent, or Firm*—Becker & Becker, Inc.

[57] ABSTRACT

A pop-top lid with a pre-formed opening which serves for dispensing the contents, is located in the lid plane, and is provided with essentially parallel side edges. The lid also includes a closure part which is provided with a tab and is slidably guided along the side edges of the pre-formed opening. The closure part is provided with an uninterrupted peripheral groove which corresponds to the shape of the pre-formed opening; to limit the slide path of the closure part, an abutment or stop is provided.

10 Claims, 12 Drawing Figures

FIG. 1
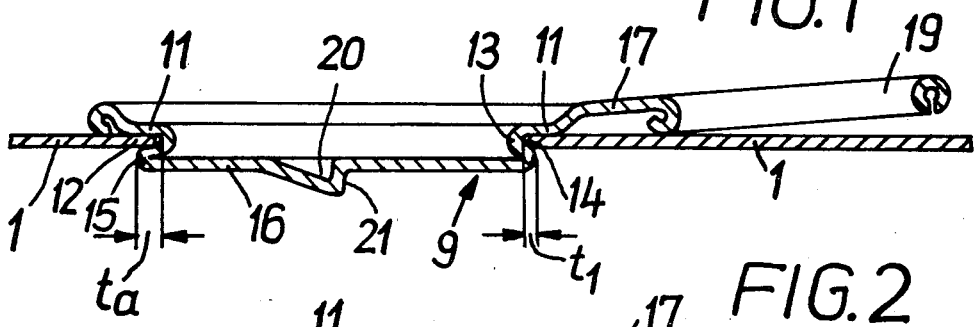
FIG. 2
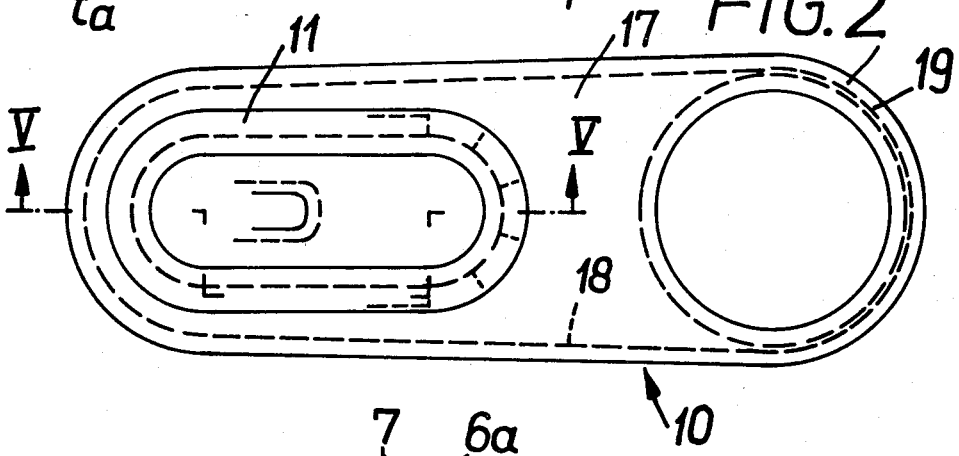
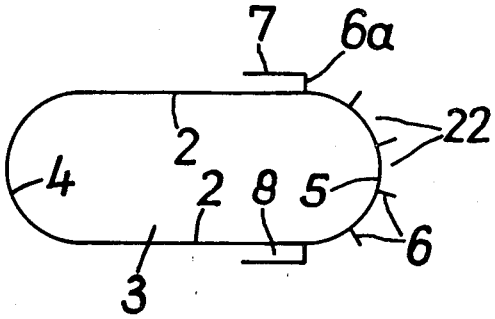
FIG. 3
FIG. 4
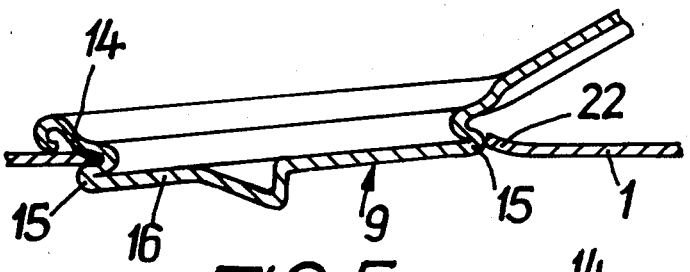
FIG. 5
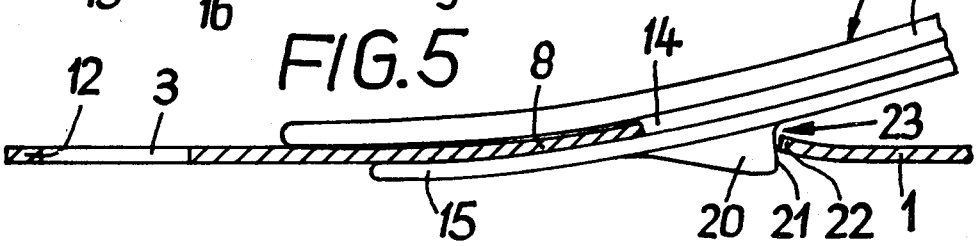

POP-TOP LID

The present invention relates to a pop-top lid with a preformed opening which serves for dispensing of the contents, is located in the lid level or plane, and is provided with essentially parallel side edges; the lid also includes a closure part which is provided with a grip part or tab and is slidably guided along the side edges of the pre-formed opening.

U.S. Pat. No. 3,856,184 discloses a pop-top lid according to which the lid or cover plate is deformed by bending and folding to a groove-shaped guide at the side edges of an off-center or eccentrically arranged dispensing opening; in the guide the sliding part of an opening tab is guided, with the tab being embodied as a double lever, grip portion being provided with a press-in projection. The cover plate or lid of the known lid is raised somewhat upwardly at one end of the dispensing opening in order to limit the position of the opening tab in one direction. To open the dispensing opening of the known lid, a separate auxiliary opening is first pushed open inwardly by the press-in projection of the grip part, along the edge of which resulting from the pushing-open, the short lever end of the grip part can be supported when the opening tab is to be moved in the guide formed by the lid.

With this known lid, the opening tab is enclosed along the longitudinal sides of the dispensing opening by the grooved guide, whereas in contrast at the ends of the dispensing opening the opening tab at any given time lies against the cover plate below or above, so that special measures are required after the mechanical working of the lid in order to seal it at these locations, especially for contents under pressure or in a vacuum. The previously known lid is further burdened with the disadvantage that the container cannot be closed again, so that the contents can come out through the separate auxiliary opening of the pop-top lid if the container is tilted or tipped over.

A pop-top lid is furthermore disclosed by U.S. Pat. No. 3,200,986, and has a pre-formed circular opening in the lid plane or level, and a corresponding closure part of elastic material. The closure part has a peripheral groove which surrounds the edge of the preformed opening when the can or container is closed. The closure part can be inserted in the lid and can be removed therefrom again. This known lid is burdened with the disadvantage that the closure part, when the can or container is opened, represents a separate part which is thrown away without thinking, increasing the environmental contamination, and which, if inadvertantly misplaced, makes it impossible to reclose the can or container.

It is an object of the present invention to provide a pop-top lid of the intially indicated type which also seals reliably with pressure differences, and according to which an opening of the preformed opening, for release of the contents, is possible without any separate auxiliary opening. Additionally, the pop-top lid is to be closable again, and the closure part, even in the open condition, is to remain continuously connected and inseparable with the pop-top lid.

These and other objects and advantages of the present invention will appear more clearly from the following specification in connection with the accompanying drawings, in which:

FIG. 1 is a longitudinal section of a portion of one embodiment of a pop-top lid with a closure element according to the teaching of the present invention;

FIG. 2 is a plan view of the closure element of FIG. 1;

FIG. 3 is a plan view of the pre-formed opening in the lid level or plane of the pop-top lid;

FIG. 4 is a longitudinal section of a portion of the closure element at the beginning of the opening procedure;

FIG. 5 is a partial longitudinal section taken along the line V—V in FIG. 2 showing the pop-top lid in the open condition;

Figure 6:
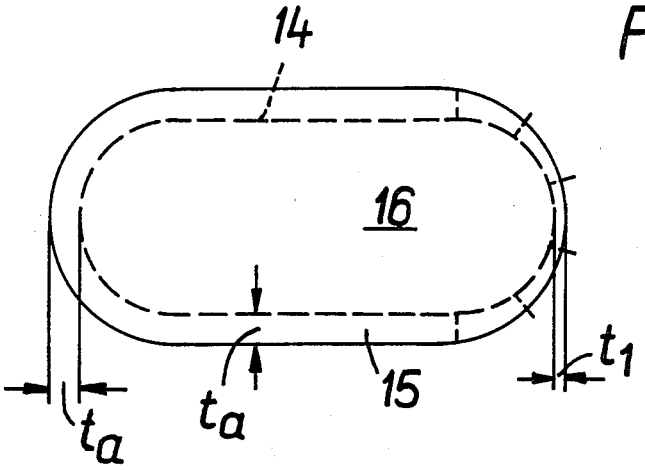
FIG. 6 illustrates the base surface of the closure part from below with a flange along the peripheral groove embodied uniformly along the side edges.

The pop-top lid of the present invention is characterized primarily in that the closure part is provided with an uninterrupted peripheral groove which corresponds to the shape of the pre-formed opening, and in that an abutment is provided for limiting the slide path of the closure part. With this embodiment of the closure part, a good sealing is obtained between the lid and the closure part, which sealing can be still further increased by a coating of sealing material.

The peripheral groove may have a depth in the region connected with the grip part which is reduced relative to the remaining periphery. The peripheral groove may be formed by a flange and auxiliary tear in score lines which are directed away from the periphery may be provided in that region of the pre-formed opening adjacent the connection between the closure part and the grip part. A pop-top lid with these features facilitates the initial opening by lifting of that region of the closure part connected with the grip part.

To facilitate removal or lifting of the closure part from the lid, the auxiliary tear line respectively closest to a given parallel side edge is arranged first perpendicular and then parallel to that side edge.

The closure part, with that part of the flange arranged in the region of the reduced depth of the peripheral groove, can be lifted from the lid by deforming the corresponding edge of the pre-formed opening for starting the opening process.

For the purpose of leaving the closure part on the pop-top lid even after opening, an abutment may be provided on the closure part. The closure part, in its base surface, may be provided with an indentation which forms this abutment and has an abutment surface directed toward the point of connection location between the closure part and the grip part. The grip part may be embodied as a dual-arm lever and may be arranged, in the starting position, over the closure part, and may be connected with the closure part by a bendable region; in addition, the lid may be provided with an elevated, transversely arranged, bead or ridge. The handle part may in its starting position, also have a transversely arranged, elevated ridge which, during bending or flipping-over of the grip part toward the lid, comes into engagement against the likewise transversely arranged ridge in the lid. The shorter lever arm of the grip part may project beyond the bendable region and, after the grip part has been flipped-over from the starting position, may be supported against the ridge arranged in the lid.

Referring now to the drawings in detail, shown in section is the lid or cover plate 1 of the lid level or plane of the pop-top lid or pull tab. The lid 1 is provided with a stamped-out opening 3 embodied with two essentially parallel side edges 2, and two semi-circular ends 4, 5. In the case of a beverage container or can, the opening 3 represents the pouring-out or dispensing opening. Short auxiliary tear or score lines 6 are arranged at end 5 and extend radially from the edge of the opening. At the transitions of the semi-circular end 5 of the opening 3 into the side edges 2, auxiliary tear or score lines 6*a* are respectively connected with auxiliary tear or score lines 7 which extend parallel to the side edges 2. Respective tongues 8 are defined or formed by the auxiliary tear lines 6*a* and 7, and the side edges 2.

The opening 3 is closed by a closure part 9 of a closure element 10. The closure part 9 engages the edge 12 of the lid 1 with a planar ring-shaped or annular surface part 11. The annular surface part 11 merges inwardly and downwardly into an annular part having an S-shaped cross section, the upper segment 13 of which forms an outwardly open peripheral groove 14 which surrounds the edge 12 of the opening 3, and the lower segment of which is embodied as a flange 15 and represents the transition from the peripheral groove 14 into the base surface 16 of the closure part 9. The lid 1 is advantageously rigidly clamped between the flange 15 and the planar surface part 11. For the purpose of further improving the seal between the closure part 9 and the lid 1, it is proposed to coat the underside of the finished pop-top lid with a non-illustrated film comprising a sealing mass, such as plastisol. However, the underside of the surface part 11 or the edge 12 of the opening 3 can also be provided with a rubber-like coating.

The planar annular surface part 11 merges into a further elevated surface 17 which has a border flange 18 along its edge, and is connected in one direction with a tab or grip portion 19. The tab 19 is embodied as a ring in the present embodiment.

Figure 7:
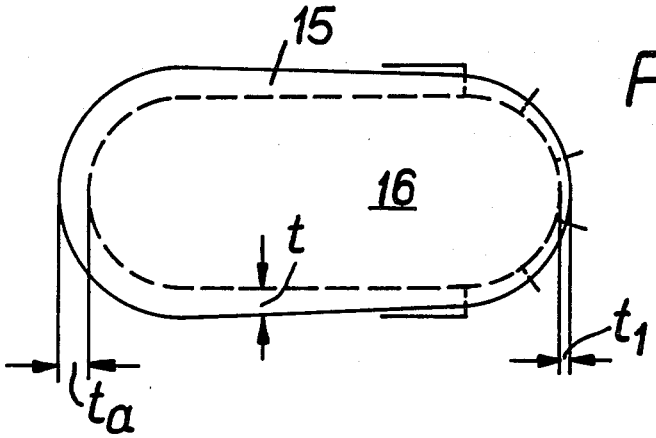
FIG. 7 shows the base surface of the closure part from below with a flange on, and changing continuously along, the periphery.

On the side where the closure part 9 is connected with the tab 19, the depth $t_1$ of the peripheral groove 14 is relatively small, and in any event is smaller than the depth t or $t_a$ at the remaining locations of the peripheral groove. In the present embodiment, the depth t increases from the smallest value $t_1$ as far as to the parallel side edges 2, from where on the peripheral groove 14 formed by the flange 15 has a uniform depth $t_a$ (see FIG. 6). It is, however, also possible for the depth to continuously increase from its smallest value $t_1$ to the value $t_a$ on the opposite side, so that for the depth t at any given location of the peripheral groove 14 of the closure parts 9, the following equation is applicable: $t_a > t > t_1$ (see FIG. 7).

A depression or indentation 20 exists in the base surface 16 of the closure part 9, and has an abutment or stop surface 21 which is directed toward the point of connection between the closure part 9 and the tab 19. In a variation from the embodiment illustrated in FIG. 1, the indentation can also be cylindrical.

The opening 3 can be opened by lifting the closure part 9 with the flange 15 over the lid 1 at the side thereof connected with the tab 19 (FIG. 4). In order to facilitate this starting of the opening procedure, the peripheral groove 14 at this location has the smallest depth $t_1$. Additionally, the auxiliary tear lines 6, 6*a* permit a spreading and rising along the edge of the opening 3 of those surface parts 22 of the lid 1 located therebetween. After lifting the closure part 9, it is pulled or drawn in the longitudinal direction of the opening 3, in which connection the parallel sides of the preipheral groove 14 slide along the parallel side edges 2 of the opening 3. The tongue 8 formed by the auxiliary tear lines 6*a* and 7 yields during the opening prodedure and makes it possible for the flange 15, which forms the peripheral groove 14, to pass upwardly from beneath the lid 1. The abutment surface 21 limits the path of the closure element 10 when it strikes or abuts against the edge of the end 5 of the opening 3, and thus precludes that the closure element 9 is separated from the lid.

Since the end 5 of the opening 3 is curved or arcuate shaped, and the base surface 16 of the closure part 9 at the level of the abutment surface 21 has a straight cross section, a venting opening is provided at the location designated with the reference numeral 23, which proves advantageous, for instance during pouring-out of the contents through the free cross section of the opening 3.

With the arrangement of the border flange 18 along the entire edge of the closure element 10, the possibility of injury is avoided, even on closure elements which may become separated.

The closure element 10 can be pushed back again after the opening. Consequently, an at least provisional reclosure can be obtained.

Figure 9:
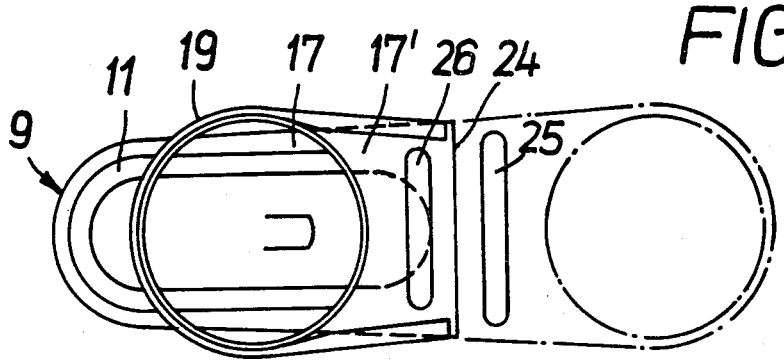
FIG. 9 is a plan view of the closure element with a bent or flipped-over tab or grip.
Figure 10:
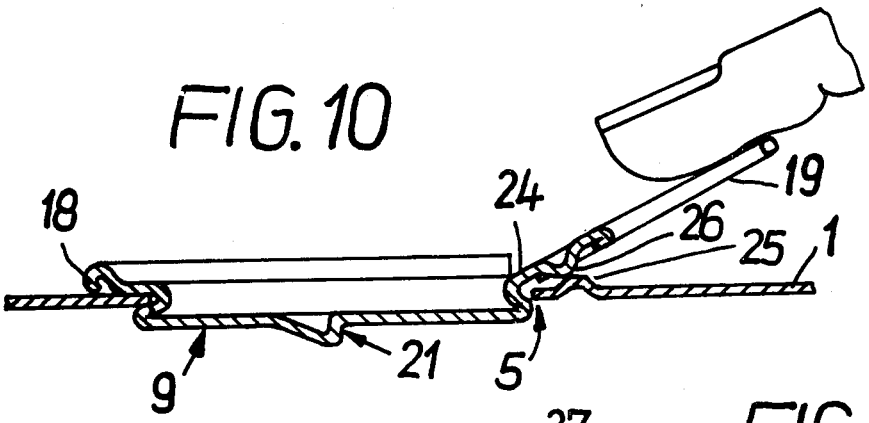
FIG. 10 is a cross section of the closure element of FIG. 9 directly before opening thereof.

As a modification of the embodiment according to FIGS. 1 and 2, the connection between the closure part 9 and the tab 19 can advantageously also be formed by a bendable region 24 of the surface part 11 or of the further surface 17. According to the embodiment of FIGS. 9 and 10, the bendable region 24 extends over the entire width of the closure element 10. The border flange 18 is interrupted for this purpose in the bendable region 24. The lid plane or surface is provided with an elevated transversely arranged bead or ridge 25 in the lid 1 in the vicinity of the end 5. The tab 19, which in its starting position essentially engages the closure part 9, likewise has a ridge 26 in its surface 17'. During bending or flipping-over of the tab 19 into the position indicated by dot-dash lines in FIG. 9, both ridges 26, 25 come against one another (see FIG. 10). Under these circumstances, the engagement point of the two ridges represents a pivot or turning point for the tab 19 enbodied as a dual-arm lever in relation to the turning point. With this embodiment, it is possible to facilitate the initial lifting of the closure part 9 from the opening 3.

Figure 11:
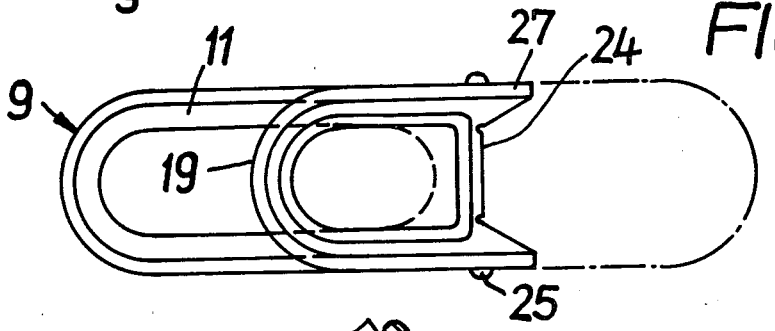
FIG. 11 is a plan view of a closure element with a bent or flipped-over tab or grip which is provided with an extension.
Figure 12:
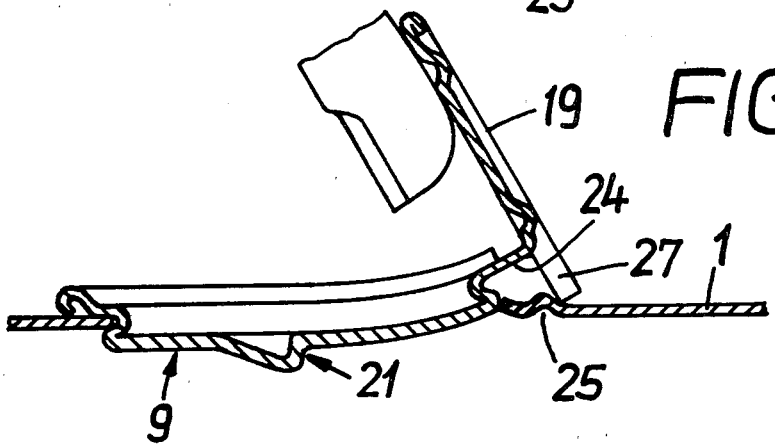
FIG. 12 is a cross section of the closure element of FIG. 11 during opening thereof.

According to the embodiment of FIGS. 11 and 12, the articulated or flexible connection between the closure part 9 and the tab 19 exist over only a part of the width of the closure element 10 in the middle. Along the edge, the tab 19 has an extension 27 which represents the shorter lever arm of the dual-arm lever tab 19. During rotation or pivoting of the tab 19, the extension 27 engages the bead or ridge 25 arranged in the lid 1, so that not only the lifting of the closure part 10 out of the opening 3 is assured, but also the initial sliding of the closure part 9 along the edges 2 of the opening 3 is facilitated.

Figure 8:
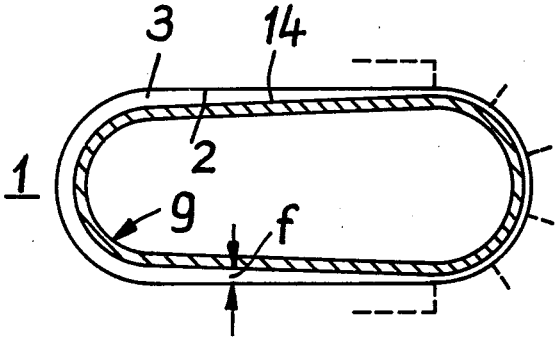
FIG. 8 is a bottom view of the pre-formed opening in the lid or cover plate, and of the closure element sectioned at the level of the peripheral groove.

The sliding of the closure part 10 can be still further facilitated thereby that the spacing f between the parallel side edges 2 and the base of the peripheral groove 14 increases as viewed from the point of connection between the closure part 9 and the tab 19 (see FIG. 8). Increase of this spacing f can advantageously take place along 1 mm to 100 mm side length.

The present invention is, of course, in no way restricted to the specific disclosure of the specification and drawings, but also encompasses any modifications within the scope of the appended claims.

What we claim is:

1. A pop-top lid for a container, said lid comprising:

a lid surface having a pre-formed opening in the plane thereof, said opening serving for dispensing the contents of said container and being provided with an edge including two essentially parallel side edge portions located on opposite sides of said opening; and a closure part which is provided with a tab and is slidably guided along said side edges of said pre-formed opening, said closure part also being provided with an uninterrupted peripheral groove which is operatively connected to said tab and corresponds in shape to the shape of said pre-formed opening, said closure part being further provided with abutment means for limiting the slide path of said closure part.

2. A pop-top lid according to claim 1, in which that portion of said peripheral groove in the region thereof connected to said tab has a depth which is less than the depth of the remainder of said peripheral groove.

3. A pop-top lid according to claim 2, in which said closure part includes a flange forming said peripheral groove.

4. A pop-top lid according to claim 3, in which that region of said closure part adjacent said opening and adjacent the connection between said closure part and said tab is provided with auxiliary score lines which are directed away from said edge of said opening.

5. A pop-top lid according to claim 4, in which that auxiliary score line respectively closest to a given parallel side edge of said opening is arranged first perpendicular and then parallel to that side edge.

6. A pop-top lid according to claim 5, in which, for starting the opening process, said closure part, with that part of said flange arranged in the region of said lesser depth of said peripheral groove, is liftable from said lid surface by deformation of said edge of said pre-formed opening.

7. A pop-top lid according to claim 5, in which said closure part is provided with a base surface which in turn is provided with an indentation which forms said abutment means and includes an abutment surface which is directed toward the point of connection of said closure part and said tab.

8. A pop-top lid according to claim 7, in which said tab is a dual-arm lever which in the starting position is arranged over said closure part; in which the connecting portion between said tab and said closure part comprises a bendable region; and in which said lid surface is provided with an elevated, transversely arranged, ridge.

9. A pop-top lid according to claim 8, in which said tab is provided with an elevated, transversely arranged ridge which in the starting position is directed away from said closure part, said ridge of said tab, when said tab is bent over away from said closure part and toward said lid surface, engages said ridge of said lid surface.

10. A pop-top lid according to claim 8, in which said tab includes an extension as the shorter arm of said dual-arm lever, said extension projecting beyond said bendable region and, when said tab is bent over away from said closure part and toward said lid surface, is supported by said ridge of said lid surface.

* * * * *